United States Patent [19]

Manders

[11] 4,410,016

[45] Oct. 18, 1983

[54] AIR SUPPLY SYSTEM FOR A PNEUMATIC LOOM

[75] Inventor: Petrus G. J. Manders, Eindhoven, Netherlands

[73] Assignee: Rüti Machinery Works Ltd., Rüti, Switzerland

[21] Appl. No.: 310,763

[22] Filed: Oct. 13, 1981

[30] Foreign Application Priority Data

Oct. 22, 1980 [CH] Switzerland ..... 7869/80

[51] Int. Cl.[3] ..... D03D 47/30

[52] U.S. Cl. ..... 139/435

[58] Field of Search ..... 139/435; 226/197

[56] References Cited

U.S. PATENT DOCUMENTS 4,143,681 3/1979 Kuda et al. ..... 139/435

4,187,888 2/1980 van Mullekom ..... 139/435

*Primary Examiner*—Henry Jaudon

*Attorney, Agent, or Firm*—Werner W. Kleeman

[57] ABSTRACT

An air supply system for a pneumatic loom contains a primary or main nozzle and a number of auxiliary nozzles. A pressurized or compressed air container or reservoir is connected by means of a primary or main control valve with a pressure line or conduit. The auxiliary nozzles are connected with the compressed air container. The primary nozzle is connected by a line with the primary control valve. This line extends, in the direction of the primary nozzle, through a pressure regulation valve and a control valve. Directly forwardly of the control valve there is arranged a compressed air storage. Consequently, there is obtained the beneficial result that the pressure in the primary nozzle, each time that the loom is placed into operation, always reaches its operating value as rapidly as possible. Thus, it is possible to dispense with the need to increase such pressure and the weft thread or filling is therefore less markedly loaded.

3 Claims, 1 Drawing Figure

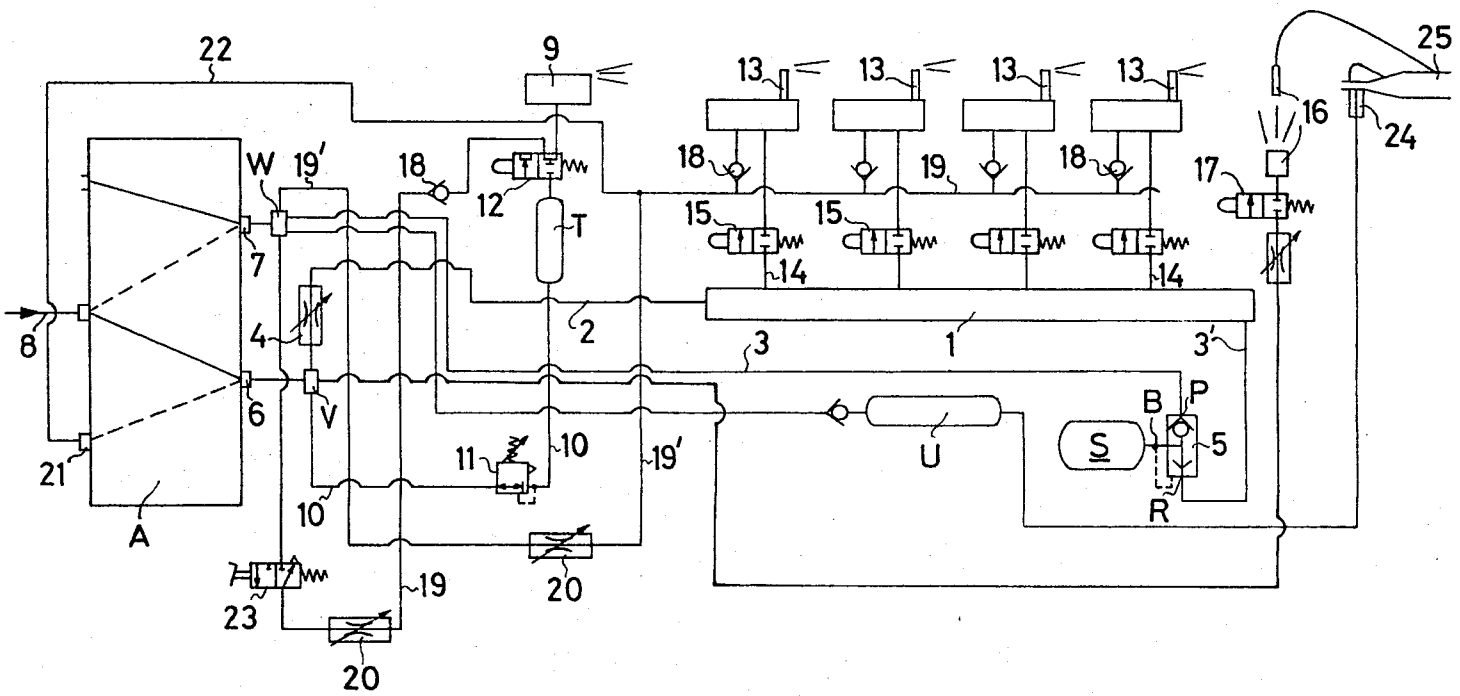
25
24
16
17
3'
P
5
B
R
S
13
14
18
19
1
U
15
3
19'
9
T
2
10
20
12
11
18
19
20
19'
V
10
W
7
4
6
23
22
A
21
8

AIR SUPPLY SYSTEM FOR A PNEUMATIC LOOM

CROSS-REFERENCE TO RELATED APPLICATION

This application is related to my copending U.S. application Ser. No. 211,102, filed Nov. 28, 1980, now U.S. Pat. No. 4,332,280, granted June 1, 1982, and entitled "Air Supply System for a Pneumatic Loom".

BACKGROUND OF THE INVENTION

The present invention relates to a new and improved construction of an air supply system for a pneumatic loom or weaving machine.

Generally speaking, the air supply system of the present development is of the type comprising a pressurized or compressed air container connected by means of a primary control valve with a pressure line. Further, there is provided a primary or main nozzle which is connected at a control valve and there are also provided a number of auxiliary nozzles connected with the compressed air container or reservoir.

SUMMARY OF THE INVENTION

An air supply system of this type is known to the art from U.S. Pat. No. 4,187,888, granted Feb. 12, 1980. This air supply system has been frequently used with considerable success in practice.

Therefore, it is a primary object of the present invention to improve upon this known air supply system, and specifically, to further enhance the supply of the primary or main nozzle during start of the loom.

Another and more specific object of the present invention, and in keeping with the immediately preceding object, is directed to a new and improved construction of air supply system for a pneumatic loom wherein the pressure of the air delivered by the primary or main nozzle, upon start of the loom, reaches its desired operating or working value as rapidly as possible.

Yet a further significant object of the present invention is directed to a new and improved construction of an air supply system for a pneumatic loom wherein the pressure of the air delivered by the primary nozzle, upon starting of the loom, reaches its desired operating value as rapidly as possible while affording maximum protection for the inserted weft thread or filling, without increasing the pressure in the primary nozzle.

Another important object of the present invention is concerned with a new and improved construction of an air supply system for a pneumatic loom, which is relatively simple in construction and design, extremely reliable in operation, economical to manufacture, not readily subject to breakdown or malfunction, and requires a minimum of maintenance and servicing.

Now in order to implement these and still further objects of the invention, which will become more readily apparent as the description proceeds, the air supply system of the present development is manifested by the features that a compressed air storage is arranged directly forwardly of the control valve of the primary or main nozzle.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing schematically illustrates a preferred embodiment of air supply system for a pneumatic loom.

DETAILED DESCRIPTION OF THE PREFERRED EMBODIMENTS

Describing now the drawing, reference numeral 1 designates a pressurized or compressed air container which is connected by means of a line or conduit 2 with a first distributor block V and by means of a line or conduit 3, 3' with a second distributor block W. The line 2 contains a throttle valve 4 and the line 3, 3' contains a valve 5 which is operatively connected with a first compressed air storage S. The first distributor block V is connected with a connection 6 and the second distributor block W is connected with a connection 7 of a primary or main control valve A of the air supply system. This primary control valve A, in the operating position indicated with solid or full lines, establishes a connection between the line or conduit 2 and a compressed air line or conduit 8.

Additionally, there is connected with the first distributor block V a line or conduit 10 leading to the primary or main nozzle 9. This line 10 extends between the distributor block V and the primary nozzle 9, in the direction of such primary nozzle 9, initially through a pressure regulation valve 11 for adjusting the pressure in the section of the line 10 downstream of the pressure regulation valve 11, and subsequently through a control valve 12. Directly forwardly of the control valve 12 there is arranged a second compressed air storage T which serves the purpose that, each time the loom is placed into operation, the pressure in the primary or main nozzle 9 attains its operating or working value without any delay. The effect of the second compressed air storage T can be still further intensified in that the cross-sectional area of the not particularly reference line or conduit between the control valve 12 and the primary nozzle 9 may be increased.

Apart from the primary nozzle 9 which, as is well known, is arranged in conventional fashion externally of the shed, there are also provided a number of so-called auxiliary nozzles 13. These auxiliary nozzles 13 are periodically pivoted into and out of the shed during loom operation. The auxiliary nozzles 13, as is to be understood from the schematic representation, may be constituted by individual nozzles or groups of such nozzles, and these auxiliary nozzles 13 are connected by the branch lines 14 with the compressed air container or reservoir 1. In each branch line or conduit 14 there is incorporated a valve 15 which may be controlled by a cam of a cam shaft of the loom as is also the case for the control valve 12. This portion of the air supply system is preferably designed in accordance with the teachings of U.S. Pat. No. 4,212,330, granted July 15, 1980, to which reference may be readily had and the disclosure of which is incorporated herein by reference. Reference character 16 designates a so-called tensioning nozzle arranged at the end of the insertion path for the weft thread or filling through the shed. This tensioning nozzle 16 is connected with the first distributor block V by means of a valve 17 likewise controlled by the loom. Consequently, the tensioning nozzle-pressure is independent of the auxiliary nozzle-pressure which may be regulated by means of the throttle valve 4. One possible construction of tensioning nozzle 16 which may be beneficially employed with the invention has been disclosed, by way of example and not limitation, in the U.S. Pat. No. 4,096,889, granted June 27, 1978, the disclosure of which is likewise incorporated herein by reference.

The primary nozzle 9 and the auxiliary nozzles 13 or groups or such auxiliary nozzles are additionally each connected by means of a check or one-way valve 18 or equivalent structure with an auxiliary supply line or conduit 19, 19' which is connected with the second distributor block W. In the position of the primary or main control valve A illustrated with broken lines in the drawing, and corresponding to the standstill position of the loom, the auxiliary supply line or conduit 19, 19' in which there is incorporated a throttle valve 20, is connected by means of the connection 7 with the compressed air line or conduit 8, whereas the compressed air container or reservoir 1, with the valves 15 closed by the action of the can shaft, can vent by means of the elements 2, V, 6, 21, an auxiliary line 22 opening into the auxiliary supply line or conduit 19, 19' as well as by means of the elements 18, 13.

The first compressed air storage S is selectively connected, during standstill of the loom, by means of the valve 5 and the line 3 with the second distributor block W, or upon start of the loom with the compressed air container 1. The valve 5 can be electrically controlled or it can also be constituted, as indicated in the drawing, by a pneumatically controlled so-called rapid vent valve. This valve or rapid vent valve may be a control or shut-off valve having two inlets P and B and a vent connection R. The inlet P is connected with the second distributor block W, the inlet B with the first compressed air storage S and the vent connection R with the compressed air container or reservoir 1. During infeed of air by the inlet P there is established a connection between the inlet P to the inlet B and the vent connection R is blocked, whereas upon infeed of air through the inlet B there is established a connection from the inlet B to the vent connection R and the other inlet P is blocked.

During standstill of the loom, represented by the broken line illustrated position of the primary control valve A, and with the compressed air source turned-on there prevails in the rapid vent valve 5 the infeed of air from the inlet P. Consequently, the vent connection R is closed and the first compressed air storage S is filled with pressurized or compressed air by means of the connection 7, the distributor block W, the line 3 and rapid vent valve 5. The auxiliary nozzles 13 are supplied with compressed air at a reduced pressure from the auxiliary supply line or conduit 19, 19' by means of the connection 7 and the throttle valve 20. At that section of the auxiliary supply line or line section 19 where there is connected the primary or main nozzle 9, there is also further incorporated a shutoff or blocking valve 23 which intentionally can be opened, for instance by being foot-actuated, in order to supply the primary nozzle 9 likewise by means of the connection 7.

During shutdown or standstill of the loom the tensioning nozzle 16 is not fed with compressed air. Instead, and again by means of the connection 7, there is fed with air a third compressed air storage U, by means of which there can be supplied with such compressed air a so-called starting tensioning nozzle 24 which ensures that a weft thread or filling located in the shed prior to start-up of the loom and which has not yet woven into the fabric, likewise will be tensioned and upon loom start-up remains in a tensioned state. One possible construction of such starting tensioning nozzle 24 is disclosed in the aforementioned U.S. Pat. No. 4,096,889.

Upon start of the loom, as represented by the full or solid line illustrated position of the primary or main valve A, there prevails at the rapid vent valve 5 the infeed of air from the inlet B, so that the contents of the first compressed storage S can empty into the compressed air container 1 by means of the vent connection R. This results in an extremely rapid pressure build-up within the compressed air container 1. The compressed air needed for the insertion of the weft thread following the starting phase of the loom is delivered to the compressed air container 1 by means of the connection 6 and the line or conduit 2.

While there are shown and described present preferred embodiments of the invention, it is to be distinctly understood that the invention is not limited thereto, but may be variously embodied and practised within the scope of the following claims. Accordingly,

What I claim is:

1. An air supply system for a pneumatic loom, comprising:

a compressed air line;

a compressed air container;

a primary control valve for operatively connecting said compressed air container with said compressed air line;

a primary nozzle;

means for connecting said primary nozzle with said primary control valve;

said connecting means including a control valve and conduit means for supplying said compressed air storage;

said primary nozzle being operatively connected with said control valve;

a plurality of auxiliary nozzles operatively connected with said compressed air container; and said connecting means further including a separate compressed air storage arranged directly forwardly of said control valve of said primary nozzle in said conduit means and operating independently of said compressed air container supplying said plurality of auxiliary nozzles.

2. The air supply system as defined in claim 1, further including:

a pressure regulation valve for operatively connecting said conduit means with said primary control valve and for adjusting the pressure in a section of said conduit means downstream of said pressure regulation valve.

3. The air supply system as defined in claim 1 or 2, further including:

line means for connecting said primary control valve with said compressed air container; and a throttle valve provided for said line means.

* * * * *